United States Patent [19]

Hogan

[11] Patent Number: 4,460,172

[45] Date of Patent: Jul. 17, 1984

[54] TENNIS TRAINING APPARATUS

[76] Inventor: John M. Hogan, 2185 Palomino Dr., Warrington, Pa. 18976

[21] Appl. No.: 310,573

[22] Filed: Oct. 13, 1981

[51] Int. Cl.[3] ..... A63B 69/38

[52] U.S. Cl. ..... 273/29 A; 273/26 E; 273/58 C

[58] Field of Search ..... 273/26 E, 26 R, 29 A, 273/197 R, 197 A, 184 B, 185 D, 200 R, 200 B; 272/76, 77

[56] References Cited

U.S. PATENT DOCUMENTS

| | | | |
|---|---|---|---|
| 805,543 | 11/1905 | Hayes | 272/76 |
| 1,170,467 | 2/1916 | Taylor | 272/76 |
| 1,962,087 | 6/1934 | Cone | 273/26 R |
| 2,305,187 | 12/1942 | Neiden | 273/29 A |
| 2,578,313 | 12/1951 | Mosley | 273/29 A |
| 2,606,025 | 8/1952 | Hornig | 273/26 R |
| 2,794,320 | 2/1974 | Salmont | 273/29 A |
| 2,948,517 | 4/1976 | Feiler | 273/29 A |
| 3,039,770 | 6/1962 | Ferretti | 273/26 R |
| 3,876,203 | 4/1975 | Gold | 273/29 A |
| 3,924,853 | 12/1975 | Schleeger | 273/29 A |
| 3,937,464 | 2/1976 | Zalewski | 273/26 R |
| 4,042,237 | 8/1977 | Moraru | 273/29 A |
| 4,105,203 | 8/1978 | Cho | 273/29 A |
| 4,191,372 | 3/1980 | Keller | 273/29 A |
| 4,204,678 | 5/1980 | Weis | 273/29 A |

FOREIGN PATENT DOCUMENTS

| | | | |
|---|---|---|---|
| 183146 | 3/1971 | United Kingdom | 273/200 B |

*Primary Examiner*—Richard C. Pinkham
*Assistant Examiner*—T. Brown
*Attorney, Agent, or Firm*—John J. Simkanich

[57] ABSTRACT

An apparatus for practicing tennis strokes, especially ground strokes, provides a support for holding a tennis ball at an initial predetermined position while allowing for a rotation of this ball about a horizontal axis of the support, this horizontal axis support being allowed to move along a predetermined ideal longitudinal axis and being biased to return to its initial position, whereby an irregular stroking of the tennis ball results in a less than ideal operation of the apparatus which is readily detected.

17 Claims, 5 Drawing Figures

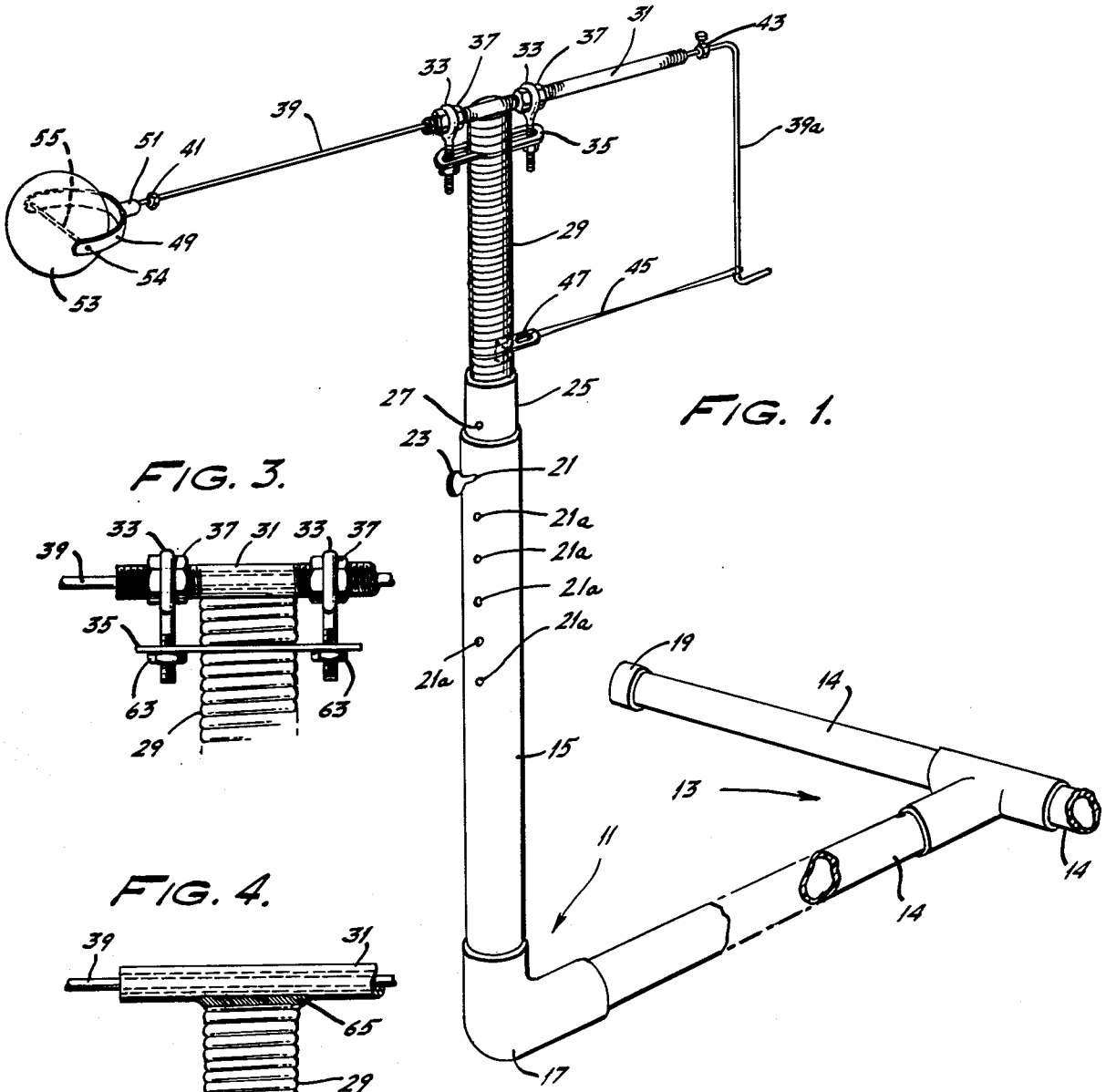
FIG. 1.
FIG. 3.
FIG. 4.
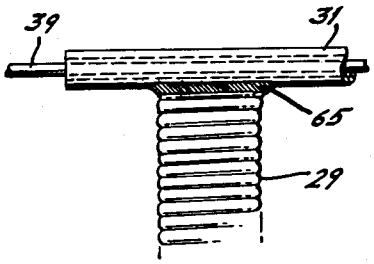
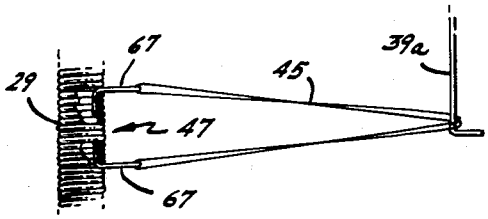
FIG. 5.
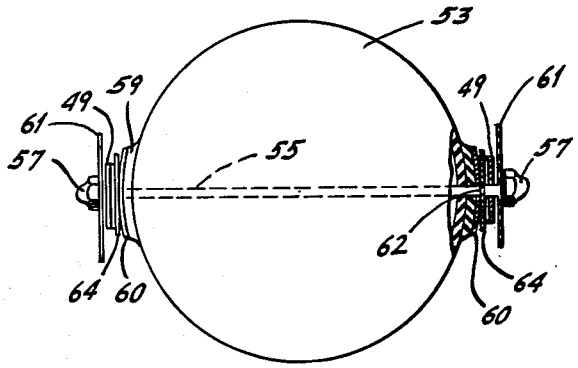
FIG. 2.

TENNIS TRAINING APPARATUS

BACKGROUND OF THE INVENTION

This invention relates to toy, game and sport apparatus and especially athletic training equipment for use in practicing motions used in the playing of athletic sports, such as ground strokes in tennis. Moreover, it relates to practice and training devices for use in practicing tennis strokes and for correcting improper stroking and follow-through, as well as developing proper form and muscle tone for carrying out the athletic activity.

Various devices have been developed which hold the tennis ball or the like in a predetermined initial position, and allow the ball to return to that predetermined initial position once the stroking has been completed. These devices are constructed to support the ball from a fixed place on its surface or from a fixed area on its surface so that the ball is not capable of being rotated about a predetermined axis passing through the ball, i.e., the ball is restrained from a natural spin which it would be capable of but for the attachment of the retaining and return structure.

Neiden, U.S. Pat. No. 2,305,187, provides a practice apparatus having a ball hung from a spring which, in turn, is attached to a horizontal support, this support being fixedly adjustable for height. Hitting the ball with a tennis racket causes the ball to travel away from the support until the spring is stretched taut. The ball is capable of flying when hit in approximately any direction, its trajectory being approximated to a curve by the force being developed by the retaining spring. While the path of the ball may approximate a straight line or a curve, there is no fixed and predetermined path or trajectory for the ball or its return path. The practicing athlete has no indication of whether the ball was correctly stroked other than his visual observation of the ball's outgoing and return trajectories and these are not readily observed.

Hornig, U.S. Pat. No. 2,606,025, teaches a tethered ball apparatus similar to that of Neiden in that a ball is hung from a retaining member which, in turn, is fixed to a horizontal support. In the design provided by Hornig, however, the biasing member is not the retainer attached to the ball but a spring located within the horizontal support to which the retaining member attaches. This device does not define a fixed predetermined ideal trajectory for the ball once it has been stroked, nor is it capable of allowing the ball to travel a straight trajectory and return.

Salmont, U.S. Pat. No. 3,794,320, teaches a recreational apparatus for developing tennis strokes with a tethered ball supported from a shaft which is rotatable about an inclined axis so that the weight of the ball returns it to the rest or initial position by gravity. The ball is supported at the end of a curved shaft which, in turn, rotates about an axis inclined from the vertical. A stroking of the ball with a tennis racket causes the ball to swing in a circle about the canted axis. No straight or longitudinal path is permitted for the ball. No pivoting or spin of the ball itself is permitted by this stroke-developing apparatus.

Feiler, U.S. Pat. No. 3,948,517, provides a practice apparatus for stroking the ball with a tennis racket. This apparatus includes a ball which is tethered to a "journal" for allowing the ball to swing in a circular arc in a vertical plane upon being struck. A U-shaped frame member holds this "journal" attached to its upper leg, so when the ball is properly struck, the tethered ball will travel in a circular pattern about this "journal" in a substantially vertical plane. If the ball is incorrectly hit, the tether line will contact at least one of the arms of the U-shaped frame, causing an irregular bouncing about of the ball and tether cord.

Gold, U.S. Pat. No. 3,876,203, teaches a practice device for tennis strokes. This device includes a resilient ball-holder to which a tennis ball is rigidly held. A resilient portion extends horizontally relative to a base and is sufficiently flexible to bend under the impact of the racket. This resilient member is supported from a base by a vertical standing arm. A second resilient portion holds the vertical standing member to a securement base. The tennis ball of the Gold apparatus is caused to travel on a curvilinear path by the constraints of the structure of the apparatus and is held rigidly by the collapsible member from free spinning upon being hit.

Schleeger, U.S. Pat. No. 3,924,853, teaches a tennis practice device for ground stroking having an upright member and an outwardly extending arm. A tennis ball is rigidly held at the end of the arm in a tethered arrangement. The upright member provides support for the tennis ball and is allowed to pivot when the ball is struck, causing the ball to travel in a curvilinear trajectory.

Cho, U.S. Pat. No. 4,105,203, teaches a tennis trainer including a generally L-shaped arm having a ball holder at one end. This ball holder holds a tennis ball in secured tether engagement while the L-shaped arm is pivotally engaged with a support and has a resilient spring section. On striking the ball, the apparatus pivots to cause the ball to swing in an arc and to return to its initial rest position once the energy from the stroke has been dissipated. No spin of the ball itself is permitted.

Weis, U.S. Pat. No. 4,204,678, provides a tennis playing apparatus which utilizes a base to support an elastically flexible wand member which carries a tennis ball at its end, this ball being rigidly tethered to the end of the wand at a position on the ball's surface. Striking the ball will cause the wand member to flex under an intended rotation of the ball and will allow the ball to travel on a curvilinear path. The torquing of the wand member will cause the ball to return to its original rest position when the energy of the stroke has been dissipated. No free spin of the ball is possible.

Keller, U.S. Pat. No. 4,191,372, provides a tennis training device for releasably holding a tennis ball at any height appropriate for practices of ground strokes and serves. This device includes a vertical support member and horizontally projecting member to which a tennis ball is releasably tethered by means of a tether cord. The fastening means used to hold the ball is of a Velcrotype hook material which lightly grips the nap of the tennis ball and releases upon impact. This device is not capable of returning the ball to its initial or rest position, nor indicating when the struck ball has deviated from its ideal path.

While almost all of these practice devices enable the tennis ball to be returned to its initial position by spring biasing or gravity or other means, the device rigidly tethers the ball to the support member whereby it cannot freely spin about a diametric axis, especially an axis in the horizontal plane. None of the structures establish an ideal longitudinal trajectory for their respective struck tennis balls. Nor do they provide an indication when the struck ball deviates from an ideal straight line trajectory.

What is desired is a tennis practice apparatus which will allow a free spinning movement of the ball and will enable the ball to more closely travel along a resultant trajectory of an actual free ball as struck during an actual tennis game. Such an apparatus must allow for the ball to spin about a horizontal axis while allowing the ball to travel along an essentially straight line off of the strings of the racket. This apparatus, moreover, should react in a specific way when the ball is ideally stroked and react in another manner when the ball is incorrectly stroked.

An object of the present invention is to provide a tennis practice and training apparatus for ground stroking whereby the tennis ball is held in an initial position and returned to that starting position once it has been stroked.

A second object of this invention is to provide such an apparatus which allows the tennis ball to freely spin about a horizontal axis upon being stroked.

A third object of this invention is to allow such a stroked tennis ball to travel along a normal trajectory or essentially straight line upon leaving the tennis racket.

Another object of this invention is to allow the tennis ball to travel, at least initially, in almost any direction upon being stroked or misstroked providing a disturbance of the operation of the invention when the ball is misstroked.

A further object is to provide such an apparatus which is adjustable as to ideal intended ball trajectory.

SUMMARY OF THE INVENTION

The objects of this invention are realized in a tennis training apparatus which is adjustable for height and for varying angles of operation.

A portable support member provides a tubular or pipe base for holding and positioning the tennis ball-stroking practice mechanism. This support member includes upstanding pipe with an adjustment for height.

Extending essentially vertically from the support member is a flexible support extension member which may be torqued in almost any direction and which is biased to return to its initial position and state for positioning the ball in a predetermined relation to the ground.

A straight hollow tube is carried on this flexible support extension. A straight rod operates within this hollow tube for guided travel and extends a distance beyond both ends of the tube. A first end of this rod is resiliently biased to a first or rest position for the rod, which may be adjustably predetermined.

In the first or rest position, the other end of the rod extends beyond the end of the hollow tube a substantial distance. A ball support structure is mounted at the end of this second end of the rod. This ball support provides a horizontally extending axis on which a tennis ball may be mounted for spinning about a diametric axis of the ball.

Cant adjustment members can be utilized to modify the extension of the flexible support extension member from the vertical position. A dampening device may be used to modify the velocity of the rod as it travels through the tube. An elastic band can be used as both the dampening device and the biasing mechanism. Stops may be incorporated on the rod at selected positions for selectively limiting the travel of the rod.

DESCRIPTION OF THE DRAWINGS

The advantages, features and operation of this invention will be better understood from a reading of the following detailed description of the invention in conjunction with the accompanying drawings in which like numerals refer to like elements and in which:

FIG. 1 is a perspective view of the assembled tennis training apparatus;

FIG. 2 is an end view of the ball support yoke structure of the apparatus of FIG. 1;

FIG. 3 is a detail of the flexible support extension member and carried hollow tube with the attachment configuration;

FIG. 4 shows an alternate attachment configuration for the hollow tube and flexible support extension; and FIG. 5 shows a detail of the flexible support extension member with cant adjustment members in place and the resilient biasing member attached to the rod.

DETAILED DESCRIPTION OF THE INVENTION

A tennis training apparatus for use in practicing ground strokes, such as top spin strokes and bottom spin or drop shot strokes, includes a tubular frame, portable support member 11, FIG. 1. This tubular base includes a T-shaped section 13 and an upright support 15. The T-shaped section is intended to lay flat on the ground. The T-shaped section 13 has three legs 14 being 9 to 20 inches long each and can be made out of any of a number of different size pipe. A nominal 2-inch outside diameter pipe is a desirable size for this structure. Upright support 15, which is about 18 to 30 inches long, is also made of the same 2-inch diameter pipe and can be held to the T-shaped section 13 by means of a pipe elbow 17. The free ends of the legs 14 of the T section 13 are each closed with a cap 19.

A threaded hole 21 is positioned to extend through the upright support 15 near the top thereof. A thumb screw 23 operates in this hole 21. This thumb screw 23 can be tightened to frictionally hold a sliding insert 25 which operates within the upright support 15.

Alternately, a series of evenly spaced holes 21, about one inch apart, can extend along the length of the upright support 15. Each of these holes 21 is threaded. The thumb screw 23 operates in one of these holes 21.

The sliding insert 25 is tubular, and is about 12 to 18 inches long. The insert 25 operates within the upright support member 15 and is held at a desired height extending out of the upright support 15 by the force of the thumb screw 23. Alternately, when the plurality of holes 21 is used, this thumb screw 23 can extend into one of a series of corresponding holes 27 in the sliding insert 25.

The choice of construction materials for the portable support member 11 includes steel pipe, aluminum pipe, iron pipe and plastic or PVC pipe. The various pieces of this support member 11, including the T section 13 with its end cap 19 and elbow 17 and the upright support 15 and tubular sliding insert 25, can be made of the same material. In the instance when this material is PVC-type plastic, the portable support 11 can be assembled by gluing or can be threaded together. Once the apparatus is set up, the pipe comprising the support member 11 can be filled with water or sand to give it weight and add to the stability as a base.

A $1\frac{3}{4}$ inch diameter spring 29 extends upwardly a distance of about 6 to 9 inches from the end of the sliding insert 25. This spring has been inserted into the end of the sliding insert member 25 for a distance of about 2 inches or more. The spring 29 can be made of a number of materials including steel, and can have medium tensional characteristics.

A straight hollow tube 31 is clamped or otherwise secured to the top end of the spring 29. This hollow tube 31 has a threaded exterior wall and a smooth approximately ¼-inch diameter bore. The tube is about 6 to 15 inches long and is held to the end of the spring 29 by a pair of ¼-inch eye bolts 33 which are clamped to a slotted plate 35. The plate 35 has been inserted between the spring 29 coils at about the fourth or fifth coil from the top end of the spring 29. Each eye bolt 33 is held in rigid position along the tube 31 by a pair of positioning nuts 37. A 3/16 to ¼ inch diameter rod 39 operates within the tube 31. This rod is approximately 15 to 30 inches long and has an L-shaped leg section 39*a* about 6 to 9 inches long at one end thereof. The straight end of this rod 39 is threaded for receiving a stop nut 41 which defines the limit of travel of the rod 39 through the hollow tube 31 in a first direction. A collar with clamping bolt 43 is fixedly positionable at the other end of the rod 39 near the L-shaped section 39*a* for limiting the travel of the rod through the hollow tube 31 in the other direction. The L-shaped section 39*a* extends downwardly from the horizontal plane of the rod 39 a distance of about 6 to 9 inches and then outwardly away from the spring 29 a distance of about 1 to 1½ inches. A resilient member, such as a rubber band 45, slips over the end of the L-shaped section 39*a* and is held by a securement 47 to the bottom end of the spring 29 near the point where it is joined to the sliding insert 25. This rubber band, which extends about 7 to 10 inches in its retracted state, biases the rod to the initial or rest position with the collar 43 abutting its respective end of the hollow tube 31.

A semi-circular yoke 49 is attached to the first end of the rod 39 by a threaded sleeve 51 portion of the yoke 49. The tennis ball 53 is held for rotation within the yoke 49 on a shaft 55, where the yoke 49 projects halfway around the tennis ball 53 and the shaft 55 extends along a diameter of the ball 53.

With this mounting arrangement, the tennis ball 53 is free to spin or rotate within the yoke 49 on the axis of the shaft 55. The shaft 55 rotates within holes 54 in the yoke 49. The yoke 49 is positioned on the rod 39 to extend in a horizontal plane with the shaft 55 also extending in that same horizontal plane.

An end view of the yoke 49 and mounting of the tennis ball 53 is shown in FIG. 2. The shaft 55 can be made from ordinary steel threaded on the ends with cap nuts 57 holding this shaft 55 on the yoke 49. The tennis ball 53 has been drilled to accept the shaft 55, and reinforcement patches 59 have been applied to the surface of the tennis ball 53 about the hole through which the shaft 55 extends, with a washer 60 bonded to each side of the ball 53 by a reinforcement patch 59 of epoxy material. The ball 53 is held in position on the shaft 55 by a pair of retaining rings 64. Each retaining ring 64 is held in place by a respective annular groove 62 carried at either end of the shaft 55. These retaining rings 64 prevent the ball 53 from becoming elipsoid when struck and help maintain the original shape of ball 53 as well as its position on the shaft 55. If needed to protect the strings of a racket from the yoke 49, large soft rubber washers 61 are placed adjacent the yoke 49.

FIG. 3 shows a detail of the securement of the hollow tube 31 to the top or free end of the spring 29. With this securement the tube 31 is held in place at the end of the spring 29 by the pressure exerted by the clamping force of eye bolts 33 in conjunction with the slotted plate 35. Each eye bolt 33 carries its own nut 63 and is held rigidly in position along the length of the tube 31 by a pair of respective positioning nuts 37. With this clamping arrangement, it is preferable to have the entire length of the hollow tube 31 threaded on its outside diameter for accepting the positioning nuts 37 and to have the eye bolts 33 sized to easily slip over the outside diameter of the tube 31. As an example, eye bolts 33 can be ¼ to 3/16 inch size. While the plate 35 is slotted to accept the threaded shaft of the eye bolts 33, in an alternative embodiment it could have a pair of holes drilled therethrough for receiving the threaded ends of the eye bolts 33.

FIG. 4 shows an alternate embodiment for the attachment of the tube 31 to the top or free end of the spring 29. In this embodiment, the tube 31 is welded by means of a weld bead 65 to the free end of the spring 29. The tube 31 need not be threaded on its outside diameter.

FIG. 5 shows a detail of the elastic or rubber band 45, securement 47. This securement 47 includes a pair of L-shaped wedges 67, which are 1/16 to ⅛ inch thick, having a loop or hole through the long leg thereof. Each of these wedges 67 is slipped between a coil of the spring 29 to have the short leg portion thereof extend along the longitudinal axis of the spring 29. Each of these wedges 67, when inserted between a coil of the spring 29, tend to change the extension of the spring 29 and cause a canting or tilting away from the vertical plane. By locating these wedges 67 or positioning a series of these wedges 67 along the spring 29, the tilt of this spring 29 from a vertical axis can be effected.

The tennis training apparatus can, therefore, be set up with the tube 31 and its operating rod 39 extending in a horizontal plane or extending in a tilted or canted plane from the horizontal with the yoke 49 being either at the lower end or the upper end of this inclined plane.

When practicing forehand or backhand top spin strokes, it is desirable to have the rod 39 operating in a slightly inclined plane because the trajectory of a tennis ball, as it comes off of a tennis racket with a top spin stroke, is along a slightly inclined trajectory. A proper stroking of the tennis ball will cause the ball to rotate with a "top spin" rotation as well as to travel in that slightly inclined plane causing the rod 39 to slide freely along the length of the inclined tube 31 until stop nut 41 strikes the tube 31. Spring 29 then deflects and returns to its original position if struck properly without any unusual oscillation. The amount of deflection is a measure of the power of the stroke. The elastic band 45 operates to return the rod 39 to its initial position whereby the tennis ball 53 is also returned to its initial position. The apparatus can be adjusted for "ball travel" by moving the collar with clamping bolt 43. By moving this collar and bolt 43 toward the ball 53, the length of travel and thereby sensitivity of the apparatus is reduced.

The apparatus can be adjusted for height by means of the thumb screw 23 and its operation with respect to the threaded hole 21 of the upright support 15 and the sliding insert 25. It is desirable, when practicing top spin ground strokes, to select an initial position for the tennis ball 53 which is most comfortable for the practicing athlete, although as the athlete becomes proficient with top spin stroking of a tennis ball from a given height, this height may be adjusted to different levels.

An improper stroking of the tennis ball 53 will cause other than a top spin rotation of the ball 53 and, or alternately, other than a simple sliding of the rod 39 down the length of the tube 31. In almost every instance, with improper stroking a torque will be applied to the rod 39 which will cause a reaction and a torquing of the spring 29, resulting in the rod 39 not completing its movement down the entire length of the tube and an oscillation of the spring 29 which is readily discernible to the practicing athlete.

The apparatus can also be set up for practicing underspins or drop shots. A proper drop shot stroke or underspin stroke will impart an underspin to the tennis ball 53 and move the rod 39 straight down the tube 31. Again, with this arrangement, improper stroking will cause a torque on the rod 39, causing it to react with the tube 31 and the spring 29, setting an oscillation in that portion of the apparatus which is readily discernible to the practicing athlete.

While many of the elements of this invention have been described as being made of steel or other material, alternate materials which will provide sufficient durability and strength can be used. As an example, the rod 39 can be made out of fiberglass or other material, as can the yoke 49. Plastics, including polyethylene, polypropylene and polycarbonate, brass, copper and even wood, as well as other materials, can be used and are contemplated as being encompassed in the invention.

Many changes can be made in the above-described tennis training apparatus without departing from the intent or scope thereof. It is intended, therefore, that all matter contained in the above description shall be interpreted as illustrative and not be taken in the limiting sense.

What is claimed is:

1. A tennis training apparatus comprising:

means for supporting a tennis ball for rotation about a horizontal axis;

means for carrying said rotation support means, said carrying means being capable of guided travel in a straight line and being connected to said tennis ball supporting means;

flexible means for positioning said carrying means in a predetermined relation to the ground;

a tubular base having an upstanding pipe upon which said flexible positioning means is mounted; and said flexible positioning means includes a spring extending up from said upstanding pipe.

2. The apparatus of claim 1 wherein said carrying means includes:

a tube mounted to the upward end of said spring;

a rod situated to slidably operate through said tube, said rod being connected to said tennis ball supporting means; and means for biasing said rod to an initial position.

3. The apparatus of claim 2 wherein said tennis ball supporting means includes:

a yoke, said yoke being attached to a first end of said rod;

a tennis ball; and a shaft extending diametrically through said tennis ball, said shaft being positioned for rotation on said yoke.

4. The apparatus of claim 3 wherein said yoke and shaft are positioned to extend in essentially the same horizontal plane, and including a pair of retaining rings on said shaft.

5. The apparatus of claim 4 wherein said rod is threaded at said first end, and wherein said yoke includes a semi-circular portion and a threaded sleeve attached thereto, said sleeve being screwably attached to said threaded rod first end.

6. The apparatus of claim 5 wherein said rod includes a downwardly projecting L-shaped section from the second end thereof.

7. The apparatus of claim 6 also including means for resiliently biasing said rod toward said first end direction.

8. The apparatus of claim 7 also including a wedge between said coils of said spring, said wedge canting said spring extension direction from the vertical.

9. The apparatus of claim 8 wherein said resilient biasing means is a rubber band about said L-shaped section and connected to said wedge to bias said L-shaped section to a position toward said wedge.

10. The apparatus of claim 7 also including a plurality of wedges between said coils of said spring, said wedges canting said spring extension direction from the vertical.

11. The apparatus of claim 10 wherein said resilient biasing means is a rubber band connected between some of said plurality of wedges and extending about said L-shaped section to bias it toward the position of said wedges.

12. The apparatus of claims 9 or 11 also including a stop nut at said rod first end.

13. The apparatus of claim 12 also including a fixedly positionable collar and clamping bolt at said rod second end.

14. The apparatus of claim 13 wherein said tube is welded to said spring.

15. The apparatus of claim 13 wherein said tube has a threaded outer surface, and also including a plate secured between coils of said spring; a pair of eye bolts securing said tube to said plate; and two pairs of positioning nuts, a pair each positioning one of said eye bolts along said tube.

16. The apparatus of claim 15 wherein said tubular base includes:

a T-shaped pipe portion;

an up-pointing pipe elbow connected to said T-shaped pipe portion; and said upstanding pipe being connected to the upward end of said pipe elbow, said upstanding pipe including a tubular insert slidably operating within an outer tubular member, said spring being inserted on its end into the upward end of said tubular insert.

17. The apparatus of claim 16 also including:

a threaded hole along said outer tubular member; and a thumb screw operating in said threaded hole and against said tubular insert.

* * * * *